United States Patent [19]

Tomlinson

[11] Patent Number: 4,836,178

[45] Date of Patent: Jun. 6, 1989

[54] INSERT FOR A TOOL

[76] Inventor: Peter N. Tomlinson, 315 Enford Road, Mondeor, Johannesburg, Transvaal, South Africa

[21] Appl. No.: 18,615

[22] Filed: Feb. 25, 1987

[30] Foreign Application Priority Data

Feb. 28, 1986 [ZA] South Africa ..... 86/1515

[51] Int. Cl.[4] ..... B28D 5/04

[52] U.S. Cl. ..... 125/39; 407/120; 299/79; 76/108 A

[58] Field of Search ..... 125/39; 76/108 A; 407/120; 299/79

[56] References Cited

U.S. PATENT DOCUMENTS

| | | | |
|---|---|---|---|
| 2,351,741 | 6/1944 | Booth | 125/39 |
| 2,587,132 | 2/1952 | Finke | 125/39 |
| 2,853,066 | 9/1958 | Loecy | 125/39 |
| 2,999,493 | 9/1961 | Blair | 125/39 |
| 3,268,259 | 8/1966 | Snipe . | |
| 3,599,737 | 8/1971 | Fischer | 76/108 A |
| 4,168,923 | 9/1979 | Vezirian | 76/108 A |
| 4,186,628 | 2/1980 | Bonnice | 76/108 A |
| 4,678,237 | 7/1987 | Collin | 299/79 |

FOREIGN PATENT DOCUMENTS

| | | |
|---|---|---|
| 0122893 | 10/1984 | European Pat. Off. . |
| 0154422 | 9/1985 | European Pat. Off. . |
| 2801675 | 7/1979 | Fed. Rep. of Germany . |
| 2846744 | 4/1980 | Fed. Rep. of Germany . |
| 2343885 | 10/1977 | France . |
| 2147037 | 1/1985 | United Kingdom . |

*Primary Examiner*—Robert P. Olszewski

*Attorney, Agent, or Firm*—Scully, Scott Murphy & Presser

[57] ABSTRACT

The invention relates to abrasive tools such as a cutting tool for a mining machine. Located in a socket 18 of the tool is a cutting insert comprising an elongate pin 22 having a bottom conical end 24 located in the recess and a top control portion 26 to which is bonded a composite abrasive compact. The composite abrasive compact having an abrasive compact layer 34 bonded to a cemented carbide substrate 36. The socket 18 complements the shape of the elongate pin 22 and, in particular, the bottom conical end 24. This arrangement minimizes the occurrence of stress raisers.

7 Claims, 1 Drawing Sheet

INSET FOR A TOOL

BACKGROUND OF THE INVENTION

This invention relates to a cutting insert for an abrasive tool such as a cutting tool for a mining machine of the type used to cut a variety of soft materials such as coal or a drill bit.

A cutting insert for such tools typically consists of a cylindrical body which is received by a recess formed in the working surface or end of the tool and an abrasive surface or edge whch protrudes from the working surface. The abrasive surface or edge is preferably made of abrasive compact.

Cutting tools for mining machines consist of a lug having one end adapted for mounting in a surface such as a drum and an opposite working end. The working end has formed therein a recess or socket which accommodates a cutting insert as described above. The insert has one abrasive end which provides the cutting tool with its cutting edge and a cylindrical body which is accommodated in the recess. Typically, the cylindrical body is brazed into the recess.

A drill bit includes a rotatable head having a plurality of inserts as described above located in recesses formed in the working surface of the head.

SUMMARY OF THE INVENTION

According to the present invention, there is provided an abrasive tool comprising a working surface in which is mounted at least one cutting insert, the cutting insert comprising an elongate pin, one end of which is located in a socket formed in the working surface, the other end of which protrudes from the working surface and an intermediate elongate portion connecting the ends, the protruding end having secured to it an abrasive element which presents a cutting edge, the intermediate portion being substantially completely located in the socket, the end located in the socket having a substantially conical shape and the socket having a complemented shape to the intermediate portion and conical end of the pin located in it.

DETAILED DESCRIPTION OF THE INVENTION

Figure 1:
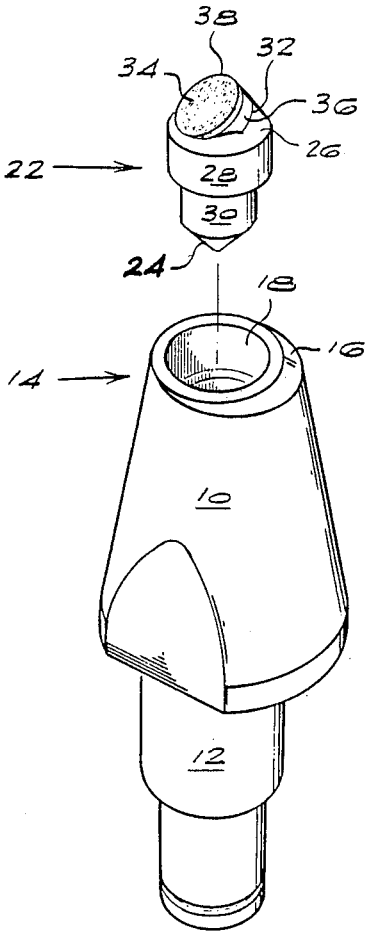
FIG. 1 illustrates a perspective view of an embodiment of the invention.

It is an essential feature of the invention that the end of the pin which is located in the socket has a substantially conical shape and that the socket has a complemental shape to the intermediate portion and conical end of the pin located in it. A number of advantages flow from this arrangement. First, there is a large contact area between the pin and the surfaces which define the socket. This provides a large brazing area which ensures a firm holding of the cutting insert in the working surface of the abrasive tool when brazing is used as the means of securing the insert in the working surface. Second, a socket may be drilled in the surface and the body of the insert shaped to conform to the drilled socket. No squaring or levelling of the end of the socket is necessary. Third, the arrangement reduces the occurrence of stress raisers which occur at the contact points of sharp angles.

The angle of the apex of the conical end of the pin will generally be in the range 90° to 150°, typically 120°.

The protruding end of the cutting insert preferably has a top conical portion to which is secured the abrasive element. The abrasive element may be located in a recess formed in the top conical portion.

The intermediate portion of the elongate pin is preferably substantially cylindrical in shape. When so shaped, this portion may have two sections of different diameter, the section of large diameter being at the protruding end of the pin.

The elongate pin may be made of any suitable material such as cemented carbide or hardened steel. The pin is preferably made of cemented carbide, typically cemented tungsten carbide.

The abrasive element will preferably be a composite abrasive compact which presents an abrasive compact cutting edge for the tool. Composite abrasive compacts are well known in the art and consist of an abrasive compact bonded to a cemented carbide substrate. The abrasive compact will be a diamond or cubic boron nitride abrasive compact. Composite abrasive compacts are described and illustrated, for example, in U.S. Patent Specifications Nos. 3,745,623, 3,743,489 and 4,063,909. The composite abrasive compact may be secured to the elongate pin by brazing or other similar method. Brazing will take place between the carbide substrate and the elongate pin.

The cutting insert may be secured against removal from the socket by methods well known in the art. A typical method is to braze the elongate pin in the socket.

An embodiment of the invention will now be described with reference to the accompanying drawings. Referring to these drawings, there is shown a cutting tool for a mining machine comprising a holding lug 10, one end 12 of which is shaped for mounting in the drum surface of a conventional mining machine and the other end 14 of which provides a working surface 16. A socket 18 is formed in the working surface 16. Located in the socket 18 is a cutting insert 20. The cutting insert comprises an elongate cemented carbide pin 22 having a bottom conical end 24, a top conical portion 26, and an intermediate portion connecting the top portion 26 and the conical end 24. The intermediate portion has sections 28, 30 of different diameter.

Figure 2:
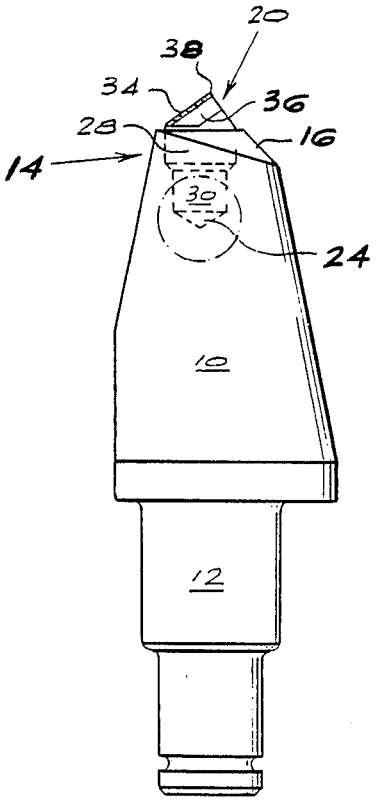
FIG. 2 illustrates a side view of the same embodiment.

The socket 18 has a complemental shape to the conical end 24 and the sections 28 and 30 of the intermediate portion of the pin. When the insert is located in the socket, as illustrated by FIG. 2, there is substantial contact between the sections 28 and 30 of the intermediate portion and the conical end 24 of the pin with the surfaces defining the socket.

Figure 3:
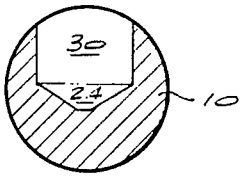
FIG. 3 illustrates a sectioned view of the ringed portion of FIG. 2.

The conical end 24 of the pin and the complementally shaped socket is illustrated in section by FIG. 3. The conical shape of the socket is produced by simply drilling a hole in the working surface 16. It will be noted that the apex of the conical end is not a sharp point, but is slightly flattened. The conical end of the pin is shaped to match and complement the socket. No levelling or squaring of the socket is required. Moreover, this configuration it has been found, reduces substantially the occurrence of stress raisers which occur when a squared-off pin is located in a squared-off socket.

The pin is preferably secured against removal from the socket by brazing.

The top conical portion 26 has a recess 32 formed therein. Located in this recess is a composite abrasive compact which comprises an abrasive compact layer 34 bonded to a cemented carbide substrate 36. The top edge 38 of the abrasive compact provides a cutting edge for the tool. The composite abrasive compact may be any known in the art but is preferably a composite diamond abrasive compact.

I claim:

1. An abrasive tool comprising a working surface in which is mounted at least one cutting insert, the cutting insert comprising an elongate pin, one end of which is located in a socket formed in the working surface, the other end of which protrudes from the working surface and an intermediate elongate portion connecting the ends, the protruding end of said pin having secured to it an abrasive element which presents a cutting edge, the intermediate portion being substantially cylindrical in shape and being substantially completely located in the socket, the end of said pin located in the socket having a substantially conical shape, and the socket having a complementary shape to both the intermediate portion and conical end of the pin located in it such that said pin and socket are in intimate engagement along the entire surfaces of said intermediate portion and conical end of the pin when said pin is located within said socket, and wherein said intermediate portion comprises two sections of different diameter, the section of larger diameter being located at the protruding end of said pin.

2. An abrasive tool according to claim 1 wherein the angle of the apex of the conical end of the pin is in the range 90° to 150° C.

3. An abrasive tool according to claim 2 wherein the angle of the apex of the conical end of the pin is 120° C.

4. An abrasive tool according to claim 1 wherein the protruding end of the cutting insert has a top conical portion to which is secured the abrasive element.

5. An abrasive tool according to claim 1 wherein the abrasive element is located in a recess formed in the protruding end of the pin and is bonded to the pin.

6. An abrasive tool according to claim 1 wherein the abrasive element is a composite abrasive compact presenting an abrasive compact cutting edge.

7. An abrasive tool according to claim 1 which is a cutting tool for a mining machine.

* * * * *